United States Patent [19]

Klee et al.

[11] 4,033,140

[45] July 5, 1977

[54] REFRIGERATION SYSTEM FOR SHIPPING CONTAINER

[75] Inventors: David J. Klee; Jack H. Godtfring, both of Emmaus, Pa.

[73] Assignee: Air Products and Chemicals, Inc., Allentown, Pa.

[22] Filed: Apr. 2, 1976

[21] Appl. No.: 673,336

[52] U.S. Cl. ..... 62/223; 62/297; 62/298; 62/449; 62/514 R

[51] Int. Cl.[2] ..... F25B 41/04

[58] Field of Search ..... 62/297, 298, 449, 514 R, 62/223

[56] References Cited

UNITED STATES PATENTS

| | | | |
|---|---|---|---|
| 3,174,299 | 3/1965 | Ellis | 62/514 R X |
| 3,675,439 | 7/1972 | Maurer | 62/514 R X |

*Primary Examiner*—Ronald C. Capossela
*Attorney, Agent, or Firm*—Ronald B. Sherer; Barry Moyerman

[57] ABSTRACT

A cryogenic refrigeration system is disclosed for being detachably mounted on a shipping container to provide in-transit refrigeration of the containerized cargo.

9 Claims, 7 Drawing Figures

FIG. 1
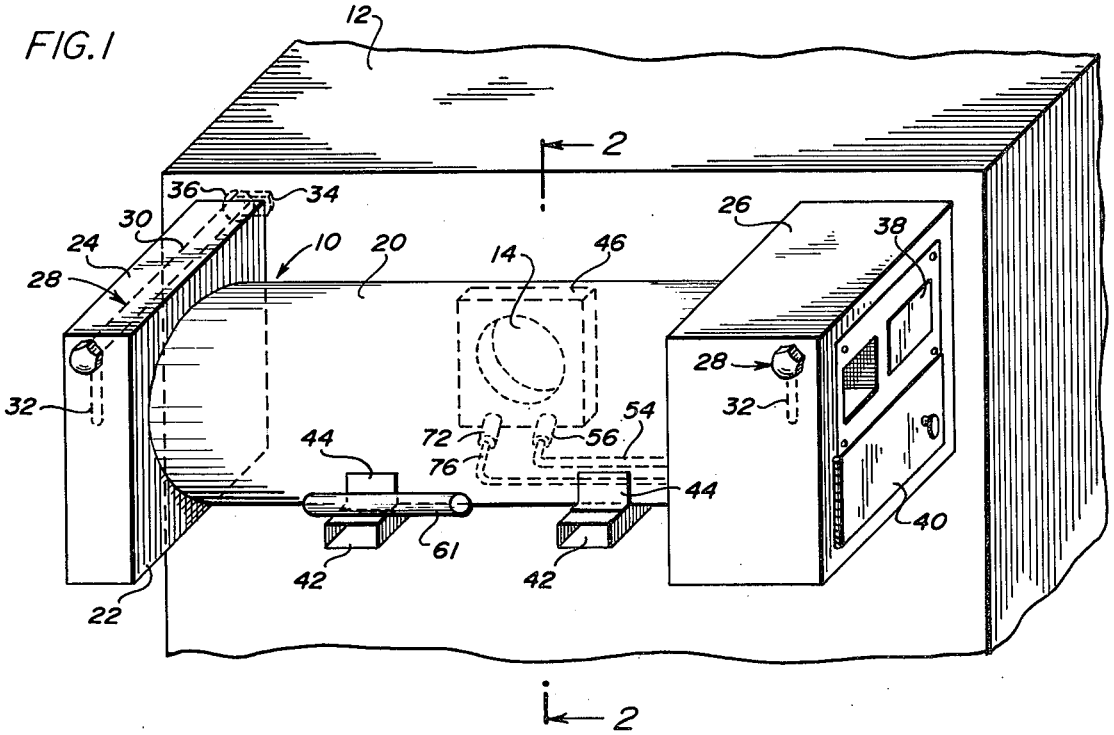
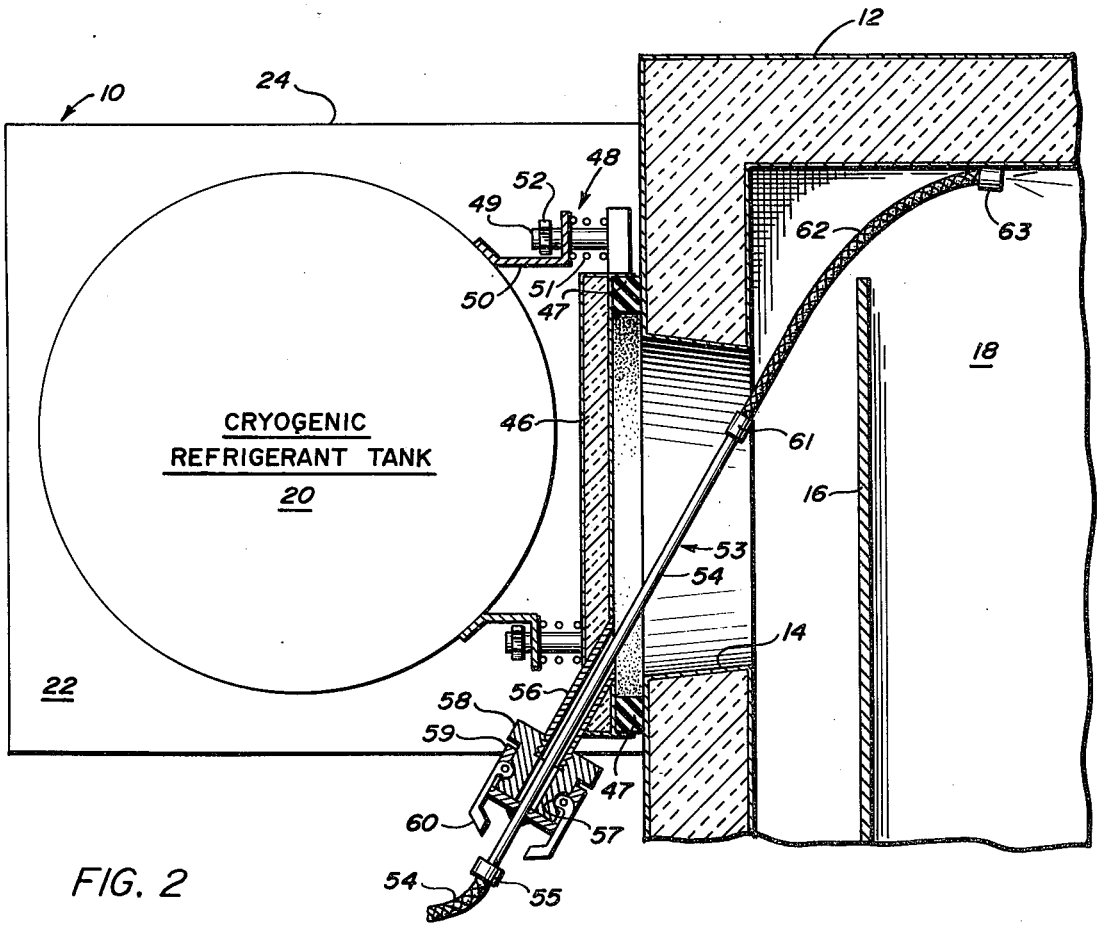
FIG. 2

REFRIGERATION SYSTEM FOR SHIPPING CONTAINER

BACKGROUND OF THE INVENTION

In recent years, the use of containerized shipping has become a predominant mode of transporting perishable goods by overseas shipment followed by rail or truck transport from the docks to the final destination. While the containers are on board the ship, cold air produced by one or more mechanical refrigeration systems is supplied to and circulated through the shipping containers by means of upper and lower portholes in the container. However, when the container is removed from the ship, a portable and detachable refrigeration system is needed for each container while it is being shipped by land to its final destination. Also, portable refrigeration systems are required for containers shipped by air or land where ocean transport is not involved.

While portable, mechanical refrigeration systems have been used to supply this in-transit refrigeration, such mechanical refrigeration systems have a number of serious disadvantages including, for example, high cost, mechanical complexity and consequent failure, and lack of rapid cool-down capacity. These disadvantages have been largely overcome by cryogenic refrigeration systems utilizing a tank of cryogenic refrigerant such as liquid nitrogen or liquid carbon dioxide, and one such system is disclosed in U.S. Pat. No. 3,675,439. However, previous cryogenic refrigeration systems have been difficult and time consuming to mount on the shipping container since numerous connections were required between the internal and external components of the refrigeration system. For example, the presence of the standard bulkhead immediately inside the porthole of the shipping container has required that the shipping container have a permanently mounted spray header or nozzle behind the bulkhead which requires connection to the externally mounted tank of cryogenic refrigerant. Similarly, the temperature sensor located within the shipping container has required connection to the externally mounted control system. In addition, two separate operations were required to connect the porthole closure plug to the container, and separately mount the refrigeration system to the shipping container. Difficulties have also been experienced in sealing the porthole closure plug to the front wall of the shipping container due to excessive bulging or indentation of the shipping container wall surrounding the porthole.

SUMMARY OF THE INVENTION

The present invention provides a cryogenic refrigeration system which is readily attached to, and detached from, a shipping container without making any connections or disconnections in either the refrigerant or sensing lines. This is accomplished by permanently connecting the porthole cover to the refrigeration system, preferably by a resilient connector assembly, and designing the refrigerant injection assembly and temperature sensing system such that all components of the system may be automatically placed in their proper position within the shipping container as the refrigeration system is attached to the shipping container in a single operation. Alternatively, the refrigerant injection tube forming part of the permanently connected refrigerant line may be separately attached to the porthole cover by a quick-connect device. More effective sealing of the porthole is also accomplished by resiliently connecting the porthole cover to the refrigeration system so as to automatically compensate for bulged or indented shipping container walls. In addition, the refrigerant injection tube may be readily removed from the shipping container for repair or replacement without disconnecting the refrigeration system from the shipping container, and similarly, the temperature sensor may be removed for repair or replacement with a minimum amount of disassembly. These and other advantages of the present invention will become more fully apparent from the detailed description of two preferred embodiments of the invention.

BRIEF DESCRIPTION OF THE DRAWINGS

FIG. 1 is a perspective view showing the refrigeration system attached to the upper portion of a shipping container.

FIG. 2 is a cross-sectional view taken along view line 2—2 of FIG. 1 illustrating one embodiment of the invention attached to a shipping container.

DETAILED DESCRIPTION OF PREFERRED EMBODIMENT

Figure 3:
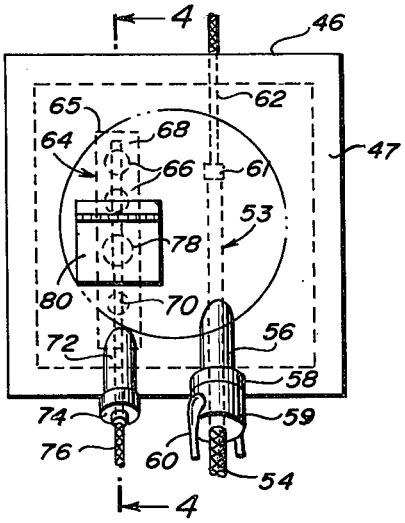
FIG. 3 is a front, elevational view of the porthole cover showing the details of the temperature sensing and refrigerant injection components.

As shown in FIGS. 1 and 2, the refrigeration system 10 is detachably mounted on the upper, front wall of a standard shipping container 12 having an upper porthole 14 through which refrigerated air is passed into the shipping container when the container is aboard a ship. It will be understood that the lower porthole (not shown) is closed by the conventional closure provided in such standard containers. It will also be noted that the standard shipping container includes a forward bulkhead 16 which maintains the cargo spaced from the interior wall of the container so as to provide for proper circulation of the cold air and prevent the cargo from blocking upper porthole 14 or the lower porthole, not shown. Accordingly, it is necessary that a detachable cryogenic refrigeration system be capable of injecting the cryogenic refrigerant into the cargo space 18 behind the bulkhead 16 and, as previously explained, this was possible in prior systems only by permanently mounting a spray header or nozzle within the shipping container to which the refrigerant line must be connected and disconnected.

The cryogenic refrigeration system of the present invention comprises a cryogenic refrigerant tank 20 having opposite ends received in, and welded to, a pair of support plates 22 forming the facing walls of a pair of support cabinets 24 and 26. The support cabinets are made of plate steel and detachably secured to the shipping container by two locking assemblies 28 one of which is shown in the upper portion of support cabinet 24. Each locking assembly comprises a rod 30 having a handle 32 at one end, and a dog 34 at the other end which is inserted into and rotated relative to the standard, oval shaped locking parts 36 provided on the shipping container. Two additional locking assemblies may be provided in the lower portions of cabinets 24 and 26, or chains may be secured to the lower portion of the container.

Support cabinet 26 also functions as a control cabinet and houses all of the the piping, controls and gauges forming the cryogenic refrigerant circuit the details of which will be subsequently described with particular reference to FIG. 6. All of the gauges are positioned so as to be visible through a side window 38, and an access door 40 is provided for filling the tank 20 with a cryogenic refrigerant such as liquid nitrogen. In order to raise and lower the refrigeration system for attachment and detachment to the upper portion of the shipping container, a pair of box beams 42 are provided for receiving the forks of a fork-lift truck. While the box beams may be attached to horizontal frame members extending between the support cabinets, it has been found that it is possible to attach the box beams directly to the upper or lower portion of the tank by means of straps or brackets 44 welded to the tank and to the box beams. Thus, the weight and cost of horizontal frame members is eliminated, and the refrigeration system is "frameless".

Figure 7:
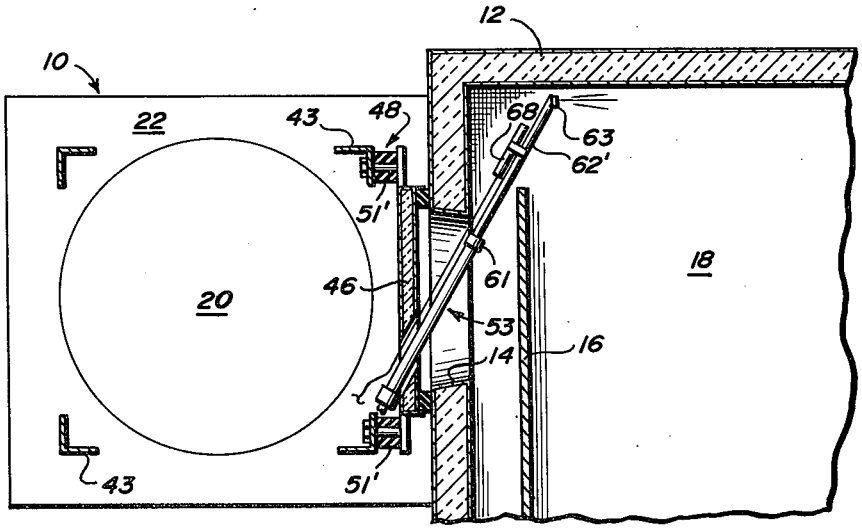
FIG. 7 is a cross-sectional view similar to FIG. 2 showing an alternative embodiment of the invention.

As further shown in FIGS. 1 and 2, the cryogenic refrigeration system includes a porthole cover 46 which may be formed of sheet metal and filled with thermal insulation. The porthole cover may be round or square and includes a sealing gasket 47 which surrounds and seals the cover over porthole 14. Contrary to the prior art, the porthole cover 46 is permanently attached to the refrigerant system. In the FIG. 1–2 embodiment, this permanent connection is made to tank 20 by a plurality of resilient connector assemblies 48. For example, the resilient connector assemblies 48 may comprise threaded rods 49 secured to the porthole cover and passing through holes in brackets 50 welded to the tank. The porthole cover is urged toward the porthole and away from the tank by compression springs 51 within the predetermined limit set by nuts 52 threaded on the end of rods 49. Alternatively, as shown in FIG. 7, porthole cover 46 may be permanently connected to horizontal frame members 43 which may extend between support plates 22, and the resilient connector assemblies 48 may include blocks 51′ of resilient material, such as rubber, in place of springs 51. In both embodiments it will be apparent that the porthole cover remains permanently connected to the refrigeration system and provides a very tight gas seal completely surrounding the porthole 14 even though the wall of the shipping container surrounding the porthole may be bulged or indented as a result of substantial previous use.

In order to inject the cryogenic refrigerant into the shipping container, porthole cover 46 carries a refrigerant injection tube 53 which extends at an angle of 25°–35° with respect to the vertical. The lower end of injection tube 53 is permanently connected to a flexible refrigerant line 54 by connector 55. The opposite end of refrigerant line 54 is permanently connected to a pipe 55 which, in turn, is permanently connected to tank 20 as shown in FIG. 6. In order to support injection tube 53 at the proper angle, which is preferably 30° from the vertical, a threaded sleeve 56 extends through the porthole cover at the proper angle and is welded or otherwise permanently secured to the porthole cover. The lower end of sleeve 56 terminates in a male connector 58 having an annular groove 57. The lower end of injection tube 53, just above connector 55, passes through and is welded to a female connector 59 having a pair of pivoted handles 60, the inner ends of which are received in groove 57 so as to lock the male and female connectors 58 and 59 together when the handles are in the illustrated position. Thus, connectors 58–59 form a quick-disconnect coupling whereby injection tube 53 may be quickly unlocked by moving handles 60 outwardly, and the entire injection tube 53 may be withdrawn through sleeve 56 without disconnecting any portion of the refrigerant line or injection tube. For example, when the cryogenic refrigerant system is not in use, injection tube 53 may be withdrawn and inserted in cylindrical holder 61 which may be welded to one of brackets 44, or to any convenient portion of the refrigerant system.

As further illustrated in FIG. 2, injection tube 53 may comprise a rigid tube portion 54, a coupling 61 and a flexible tube portion 62 the latter of which terminates in a spray nozzle 63. Flexible tube portion is sufficiently stiff to be self-supporting while still being sufficiently flexible to snake itself between the top of bulkhead 16 and the interior surface of the top wall of the shipping container. For example, braided metal hose manufactured by the Flexline Division of U.S. Brass and Copper Co. has been found to have an excellent degree of stiffness versus flexibility, and other forms of flexible or semi-flexible tubing are also usable. The use of flexible portion 62 is of substantial importance in properly positioning nozzle 63 relative to bulkhead 16, and is particularly important when the cryogenic refrigerant system is to be used with shipping containers of different manufacturers since the height and spacing of bulkheads 16 and portholes 14 may vary from one container to the next. However, if the refrigerant system is to be used only with containers of the same type having bulkheads of the same height and spacing from the front wall of the container, it has been found that injection tube 53 may comprise rigid tubing throughout its lengths as shown in FIG. 7. In this embodiment, the same coupling 61 may be used to attach a second tube portion 62′ having a spray nozzle 63 brazed to its upper end. In this manner, rigid tube portions 62′ of various lengths may be used for different containers, if necessary, or injection tube 53 may comprise a single rigid tube of predetermined length.

Figure 4:
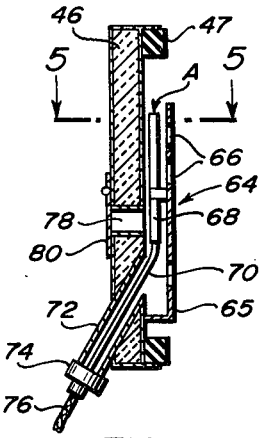
FIG. 4 is a sectional view of the porthole cover taken along view line 4—4 of FIG. 3.
Figure 5:
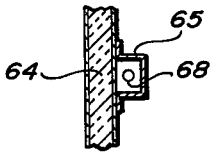
FIG. 5 is a fragmentary, cross-sectional view of the temperature sensing assembly taken along view line 5—5 of FIG. 4.

As shown more clearly in FIGS. 3, 4 and 5, the porthole cover 46 also includes a permanently connected sensor assembly 64 which includes a channel-shaped guard 65 having a plurality of holes 66. The temperature sensor 68 is positioned between the porthole cover 46 and the guard 65 and is suitably supported by a bracket connected to either the guard 65 or the porthole cover 46. Temperature sensor 68 is connected through a capillary tube 70 passing through an inclined sleeve 72 to a connector 74 which is removably secured to the end of sleeve 72. Connector 74 permanently attaches an armor cable around the capillary tube to form a sensing or signal line 76 the other end of which is permanently connected to an automatic temperature controller the operation of which will be subsequently described.

Porthole cover 46 also functions to vent vaporized refrigerant from the shipping container by the provision of vent passage 78 having a hinged cover or flap 80 to prevent infiltration of ambient air. Preferably, cover or flap 80 may be provided with a magnetic strip (not shown) which maintains the cover in closed position until the pressure of the gas in the container reaches a predetermined value.

Depending upon how gas-tight the shipping container is, the temperature sensing assembly and the vent passage 78 with hinged cover 80 may operate in slightly different modes. That is, if the shipping container is relatively gas-tight, the vaporized refrigerant will be vented by passing downwardly through channel-shaped guard 65 as shown by flow arrow A. After flowing past temperature sensor 68, the gas is then vented through vent passage 78 since the pressure is sufficient to open hinged cover 80. On the other hand, if the shipping container has developed a number of gas leaks due to substantial use, then the pressure of the vaporized refrigerant may not be sufficient to overcome the force of the magnetic strip and open cover 80. In this event, however, the temperature sensor 68 still operates to sense an accurate reading of the temperature of the shipping container due to the plurality of openings 66 in guard 65 which permit free circulation of the refrigerant gas in contact with the sensor. In either event, hinged cover 80 serves as an energy vent in the event of an excessive buildup of refrigerant gas pressure within the shipping container.

While the sensor assembly just described forms one preferred embodiment, it will be apparent that the sensor 68 may be positioned in other locations. For example, the sensor 68 may be carried by injection tube 53 as shown in FIG. 7, or it may be separately attached to the inside of the container by a clip or hook although this is disadvantageous since a separate attaching step is required. Thus, it is preferred that the sensor be attached to and carried by some portion of the refrigeration system such as cover 46, injection tube 53, or a removable lance (not shown) which may extend through sleeve 72.

The complete mode of operation will now be described with particular reference to the details of the refrigerant circuit shown in FIG. 6, in connection with all of the components already described in FIGS. 1–5 and 7. The refrigerant tank 20 is filled through fill connection 82 and fill valve 83. During filling, vapor is vented from the tank through vent line 84 containing a vent valve 85. During the normal operation of the system, any excess pressure in the refrigerant tank is normally vented through pressure relief valve 86 and, in the event of the failure of this valve, excess pressure is vented through burst disc 87. The level of the cryogenic liquid is continuously indicated by liquid level indicator 88, and the tank pressure is indicated by pressure gauge 89.

After the tank has been filled, a fork-lift truck engages box beams 42 and raises the refrigerant system 10 to the height at which spray nozzle 63 and injection tube 53 will enter porthole 14. The fork-lift truck then moves forward so as to insert the nozzle and injection tube through the porthole closure and the refrigeration system is further raised until dogs 34 enter locking ports 36 and handles 32 are rotated 90° so as to lock the refrigeration system to the shipping container. During this forward and upward movement of the refrigeration system, injection tube 53 is inserted to the position shown in FIG. 7 since the angle and length of the tube are predetermined for the particular dimensions of the bulkhead. Alternatively, where different types of containers are involved, the spray nozzle 63 and flexible portion 62 of the FIG. 2 embodiment snake their way over bulkhead 16 into the position illustrated in FIG. 2. Thus, the refrigeration system may be attached in a single operation. However, the present invention also provides for a second mode of attachment in which the injection tube may remain in holder 61 while the refrigeration system is attached to the container as just described. Thereafter, the injection tube is removed from the holder, inserted through sleeve 56 to the position illustrated in either FIG. 2 or 7, and locked in place by handles 60. In either mode of attachment, no connection is required in either the refrigerant or signal lines, and the refrigeration system is ready to be turned on.

Figure 6:
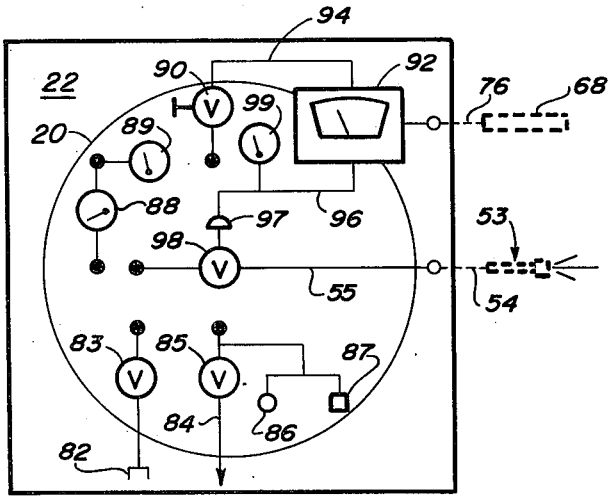
FIG. 6 is a side elevational view of the end of the refrigeration system showing the refrigeration circuit in schematic form.

As most clearly shown in FIG. 6, the system is turned on by opening manual valve 90 which supplies pneumatic pressure from the tank to temperature controller 92 through line 94. The warm temperature in the container is sensed by temperature sensor 68 which supplies a signal through signal line 76 to controller 92. Controller 92 sends a pneumatic signal through signal line 96 to actuator 97 open liquid refrigerant control valve 98 and supply cryogenic liquid refrigerant through pipe 55 and flexible refrigerant line 54 to injection tube 53 and nozzle 63 which sprays the liquid refrigerant into the cargo chamber where it immediately vaporizes and becomes the refrigerant gas. Injection continues until sensor 68 detects that the predetermined temperature has been reached, and the controller actuates valve 98 to close until the temperature again rises and requires further injection of liquid refrigerant. Pressure gauge 99 in line 96 indicates when pressure is being applied to valve actuator 97 and thereby indicates whenever control valve 98 is open such that liquid refrigerant is being injected into the container.

From the foregoing description, it will be apparent that the present invention provides a highly portable, light weight refrigeration system which may be readily attached and detached to any land, air or seagoing shipping container by simply moving it into position and turning the locking assemblies. It will also be apparent that numerous modifications may be made within the principles of the invention. For example, one or both of supporting cabinets 24 and 26 may comprise simple mounting frames with the controls located in a separate or integral cabinet. Pneumatic controller 92 may be substituted by an electric controller actuating a solenoid operated flow control valve, and it will be apparent that each of the individual components of the refrigeration systems shown in FIG. 2 and 7 may be employed in the other embodiment. For example, springs 51 and/or the flexible tube portion 62 may be used in the FIG. 7 embodiment, while the rigid tube portion 62' and/or resilient blocks 51' may be used in the FIG. 2 embodiment. Numerous other changes will also be apparent to those skilled in the art. Accordingly, it is to be understood that the foregoing description is intended to be illustrative rather than exhaustive, and that the invention is not limited other than as set forth in the following claims under the doctrine of equivalents.

What is claimed is:

1. A cryogenic refrigeration system, for detachable mounting on a shipping container having a porthole, comprising, a. a cryogenic refrigerant storage tank, b. support means including locking assemblies for detachably securing said storage tank to said container externally of the porthole, c. a porthole cover permanently attached to and carried by said refrigeration system, said cover being positioned relative to said locking assemblies such as to automatically cover the porthole when said refrigeration system is mounted on the shipping container by said locking assemblies, d. a refrigerant injection tube supported by said porthole cover and positioned at an angle relative to the vertical plane of said cover such as to pass through said porthole and having a length such as to terminate adjacent the upper, internal wall of the shipping container, said injection tube being connected by a refrigerant line to said refrigerant tank, e. a temperature sensor for sensing the temperature in said container, said temperature sensor being connected to one end of a signal line, f. a temperature controller connected to the opposite end of said signal line, g. a refrigerant flow control valve in said refrigerant line intermediate said refrigerant tank and said injection tube, h. a valve actuator connected to said refrigerant flow control valve, and i. a signal line connected from said temperature controller to said valve actuator for controlling the flow of cryogenic refrigerant as a function of the temperature sensed in the container by said temperature sensor.

2. The cryogenic refrigeration system as claimed in claim 1 wherein said injection tube is permanently connected to one end of said refrigerant line the other end of which is permanently connected to said refrigerant tank, and wherein opposite ends of said signal line are permanently connected to said temperature sensor and to said controller whereby said cryogenic refrigeration system may be attached to and detached from the shipping container without coupling or uncoupling either the refrigerant or signal lines.

3. The cryogenic refrigeration system as claimed in claim 1 including resilient connector assemblies connecting said porthole cover to said refrigeration system whereby said cover may move relative to said refrigeration system and tightly seal the porthole in a non-planar wall of the shipping container.

4. The cryogenic refrigerant system as claimed in claim 1 wherein said injection tube includes a flexible portion of sufficient rigidity to be self-supporting and sufficiently flexible to snake its way over a bulkhead in the shipping container.

5. The cryogenic refrigerant system as claimed in claim 1 wherein said injection tube extends at an angle of 25° to 35° from the vertical.

6. The cryogenic refrigerant system as claimed in claim 1 wherein said injection tube is mechanically connected to said porthole cover by a quick-disconnect coupling.

7. The cryogenic refrigeration system as claimed in claim 1 wherein said temperature sensor is attached to and carried by the refrigeration system.

8. The cryogenic refrigeration system as claimed in claim 1 wherein said temperature sensor is attached to and carried by said porthole cover.

9. The cryogenic refrigeration system as claimed in claim 1 wherein said temperature sensor is attached to and carried by said refrigerant injection tube.

* * * * *